US008366943B2

(12) United States Patent
Järvinen

(10) Patent No.: US 8,366,943 B2
(45) Date of Patent: Feb. 5, 2013

(54) APPARATUS AND METHOD FOR COLLECTING MATERIAL FROM WATER SYSTEMS

(75) Inventor: Markku Järvinen, Lielax (FI)

(73) Assignee: Oilwhale Oy, Lielahti TL (FI)

( * ) Notice: Subject to any disclaimer, the term of this patent is extended or adjusted under 35 U.S.C. 154(b) by 123 days.

(21) Appl. No.: 12/738,311

(22) PCT Filed: Jun. 27, 2008

(86) PCT No.: PCT/FI2008/050391

§ 371 (c)(1),
(2), (4) Date: Jun. 30, 2010

(87) PCT Pub. No.: WO2009/050330

PCT Pub. Date: Apr. 23, 2009

(65) Prior Publication Data

US 2010/0275833 A1 Nov. 4, 2010

(30) Foreign Application Priority Data

Oct. 17, 2007 (FI) ..... 20070776

(51) Int. Cl.
*C02F 1/40* (2006.01)

(52) U.S. Cl. ..... 210/776; 210/242.3; 114/61.1

(58) Field of Classification Search ..... 114/61.1; 210/242.1, 923, 242.3, 170.05, 171.1, 170.11, 210/776
See application file for complete search history.

(56) References Cited

U.S. PATENT DOCUMENTS

| | | | | |
|---|---|---|---|---|
| 1,591,024 | A | 7/1926 | Dodge | |
| 3,708,070 | A | 1/1973 | Bell | |
| 3,727,766 | A | 4/1973 | Horne et al. | |
| 3,737,040 | A | 6/1973 | Brydoy et al. | |
| 3,754,653 | A | 8/1973 | Verdin | |
| 3,822,789 | A | 7/1974 | Crisafulli | |
| 3,966,614 | A | 6/1976 | Ayers | |
| 4,033,876 | A | 7/1977 | Cocjin et al. | |
| 4,049,554 | A | 9/1977 | Ayers | |
| 4,053,406 | A | 10/1977 | Deslauriers et al. | |
| 4,128,068 | A | 12/1978 | Ogura et al. | |
| 4,139,470 | A | 2/1979 | Stagemeyer et al. | |
| 4,265,757 | A * | 5/1981 | Ivanoff | 210/242.3 |
| 4,356,086 | A | 10/1982 | Öberg | |
| 4,363,735 | A | 12/1982 | Hook | |
| 4,372,854 | A | 2/1983 | Szereday | |
| 4,381,994 | A | 5/1983 | Ayers | |

(Continued)

FOREIGN PATENT DOCUMENTS

| | | |
|---|---|---|
| EP | 0 716 188 | 6/1996 |
| RU | 2 220 253 | 9/2003 |

(Continued)

*Primary Examiner* — Stephen Avila
(74) *Attorney, Agent, or Firm* — Nixon & Vanderhye P.C.

(57) ABSTRACT

The invention relates to an apparatus and method for collecting material from a water system, especially from the surface or close to the surface of a water system. The method comprises: maneuvering an apparatus with a cargo space in a water system; conducting water, present in the surface and close to the surface of the water system, and material therein to be collected, in response to the vessel's advancing speed through a collect opening, located in a fore section of the apparatus in its traveling direction, into the cargo space; conducting water from the cargo space back into the water system through an exhaust opening in the cargo space's bottom.

10 Claims, 4 Drawing Sheets

U.S. PATENT DOCUMENTS

| | | | | |
|---|---|---|---|---|
| 4,511,470 | A | 4/1985 | Ayroldi | |
| 4,595,510 | A | 6/1986 | Winbladh et al. | |
| 4,610,635 | A | 9/1986 | Austevoll | |
| 4,921,605 | A * | 5/1990 | Chastan-Bagnis et al. | 210/115 |
| 5,045,217 | A | 9/1991 | Ronan et al. | |
| 5,158,673 | A | 10/1992 | Halter | |
| 5,207,901 | A | 5/1993 | Ravagnan | |
| 5,292,430 | A | 3/1994 | Sullivan et al. | |
| 5,478,483 | A | 12/1995 | Gore | |
| 6,073,382 | A | 6/2000 | Willener | |
| 6,905,597 | B2 | 6/2005 | Garbaty et al. | |
| 7,037,038 | B1 | 5/2006 | Haski et al. | |
| 7,452,462 | B2 | 11/2008 | Joliet | |
| 7,785,035 | B2 * | 8/2010 | Jarvinen | 405/60 |
| 2006/0104720 | A1 | 5/2006 | Haski et al. | |
| 2009/0206043 | A1 * | 8/2009 | Haagensen et al. | 210/776 |

FOREIGN PATENT DOCUMENTS

| | | |
|---|---|---|
| WO | 90/12156 | 10/1990 |
| WO | 03/071035 | 8/2003 |
| WO | 2005/097592 | 10/2005 |
| WO | 2007/010086 | 1/2007 |

* cited by examiner 1
2
3
3a
3b
4
5
6
7
10
11
12
20
21
22
23
24
25
5'
7'
25'

APPARATUS AND METHOD FOR COLLECTING MATERIAL FROM WATER SYSTEMS

This application is the U.S. national phase of International Application No. PCT/FI2008/050391 filed 27 Jun. 2008, which designated the U.S. and claims priority to FI Application No. 20070776 filed 17 Oct. 2007, the entire contents of each of which are hereby incorporated by reference.

TECHNICAL FIELD OF THE INVENTION

The invention relates to an apparatus and a method for collecting material from water systems according to the preambles of the independent claims presented below. The invention relates, for example, to a new effective way of controlling occurred oil spills and rescuing people from waters.

PRIOR ART

Drawbacks in prior known oil-combating methods include, among others, a low collection capability, a poor functionality in icy water, a need of frequent cleaning and maintenance caused by soiled brushes and other skimming equipment. A major drawback is a low storage capacity for recovered oil. Unloading congealed oil has presented significant problems. The cleanup of oil-soiled shores with prior known methods is difficult, slow and inefficient.

Collecting materials other than oil from water systems is also often inconvenient and slow. For example, rescuing people, who have ended up in water, from water, especially in high waves, is difficult with today's methods.

OBJECT AND SUMMARY OF THE INVENTION

An object of the present invention is to reduce or even eliminate some of the above-mentioned problems appearing in the prior art.

A particular object of the present invention is to provide a new and effective way of collecting various materials from the surface or close to the surface of water systems, as well as a new type of logistic arrangement for efficient handling of such a collection process.

It is a specific object of the present invention to provide an effective way of controlling oil spills, as well as an effective way of saving people, who have ended up in water, from water.

In view of achieving, among others, the above-mentioned objects, an apparatus and a method for collecting material from a water system are characterized by what is set forth in the characterizing parts of the appended independent claims.

The embodiments and benefits described in this specification apply, as appropriate, both to an apparatus and to a method according to the invention for collecting material from a water system, even if this is not always specifically mentioned.

A typical apparatus according to the invention for collecting material from a water system, especially from the surface or close to the surface of a water system, comprises

- a cargo space;
- a collect opening, located in a fore section of the apparatus in its traveling direction and in communication with the cargo space, for conducting water and material therein to be collected into the cargo space;
- an exhaust opening in the vessel's bottom, leading from the cargo space back to the water system.

The number of collect openings or exhaust openings can also be more than one of each.

A typical method according to the invention for collecting material from a water system, especially from the surface or close to the surface of a water system, comprises

- maneuvering an apparatus with a cargo space in a water system;
- conducting water, that is present in the surface and close to the surface of the water system, and material therein to be collected, through a collect opening, located in a fore section of the apparatus in its traveling direction, into the cargo space;
- conducting water from the cargo space back into the water system through an exhaust opening in the cargo space.

Typically the water, and the material therein to be collected, stream into the cargo space in response to the vessel's advancing speed and the water present on the bottom of the cargo space discharges by itself through a water exhaust opening in the vessel's bottom back into the water system.

In one embodiment of the invention, the exhaust opening is located in a bottom aft section of the cargo space. The aft section refers to a rearward half of the cargo space in the apparatus' traveling direction during the collection process.

In one embodiment of the invention, the apparatus comprises buoyant elements, such as pontoons, for making sure that the apparatus is unsinkable.

In one embodiment of the invention, the apparatus comprises buoyant elements, the buoyancy of which is adaptable as desired for adjusting the draught of the apparatus. Accordingly, the buoyant elements may comprise at least one ballast tank and means, such as pumps and necessary power units, for its loading and unloading. The number of ballast tanks can be more than one.

In one embodiment of the invention, in connection with the collect opening there are controllable closing means, such as gates, for varying the size of the collect opening. This enables controlling the amount of water streaming into the apparatus through the collect opening.

In one embodiment of the invention, in connection with the exhaust opening there are controllable closing means, such as gates, for varying the size of the exhaust opening. This enables controlling the amount of water running out of the apparatus through the exhaust opening.

By the surface area of a collect opening or collect openings is meant the area of those parts of collect openings which are below the water level in a direction perpendicular to the main flowing direction of incoming water. By the surface area of water exhaust openings is meant the area of those parts of exhaust openings which are below the water level in a direction perpendicular to the main flowing direction of water streaming out of the opening into a water system. The total area of water exhaust openings is typically equal to or larger than that of the underwater opening part of a collect opening leading to the cargo space. In one embodiment of the invention, the exhaust opening has a surface area of 0.5-5, preferably 1-3, times that of the collect opening.

The operation of one typical embodiment of the invention can be described as follows. When the apparatus is in active operation and water is flowing into the cargo space, the liquid level in the cargo space, especially in an aft section of the cargo space due to a so-called stagnation pressure, strives to rise to a somewhat higher level than the surface of a surrounding water system. As the vessel is advancing, there is water discharging from the bottom of the cargo space, from below a floating material, gravitationally back into the surrounding water system. As the water has a relatively modest flow rate out of the water exhaust opening, the material to be collected, for example oil, does not work its way through the water exhaust openings back into the water system but, instead, remains floating on the surface of water present in the cargo space. As the collection continues, the water streaming into the cargo space finds its way below the floating material, and the floating material becomes congested on the surface of water. The apparatus according to the invention enables even most of the cargo space to be gathered full of a floating material before some of the floating material begins to discharge through the water exhaust openings. The flow rate from water exhaust openings can be regulated with the vessel's advancing speed or by controlling the size of the collect opening or exhaust openings. For example, as the cargo space begins to fill up with a material to be collected, the traveling speed can be dropped or the openings can be reduced in size. When a desired amount of the material to be collected has been collected to the vessel's cargo space, the collect opening or openings as well as the water exhaust opening or openings will be closed and the floating material present in the apparatus will be transported to a further treatment.

The flow rate from water exhaust openings into a water system depends on the rate of inflow to the cargo space, i.e. on the vessel's running speed and the collect opening's area. The conducted tests have confirmed that, when the water exhaust openings are larger in area than the collect opening, the water and the material floating on its surface remain at least mainly separate in the cargo space, nor does hardly any floating material discharge through the water exhaust openings. The water exhaust openings can have an area which is for example 0.5-5 or 1-5 times larger than the area of the collect opening. The size of openings and the traveling speed of the apparatus can be chosen, for example, such that the flow rate from exhaust openings into a water system is 0-1 m/s or 0-0.5 m/s.

In case the vessel is provided with some sort of flow impediments, for example in the form of a mainly horizontal intermediate floor, the exhaust openings need not necessarily be very large. The removal of water can be managed even through a smaller opening, provided that the removal of a material to be collected is at the same time impeded for example by means of intermediate floors comprising flow ports having an area which is equal to or larger than that of the exhaust openings. The intermediate floors may cover an entire cargo space or, for example, parts of a cargo space located above the exhaust openings in the bottom of the cargo space.

One apparatus according to the invention for collecting material from a water system is adapted to be floating and mobile on the surface of water. Such an apparatus includes at least:

- a cargo space for holding a collected material,
- a collecting means, such as a collect opening, for leading water of a water system and/or material to be collected in it to the cargo space,
- water exhaust means for discharging water from the cargo space,
- at least one ballast tank for controlling the draught of the cargo space as desired and/or means for controlling the efficiency of the water exhaust means.

A typical ballast tank according to the invention is divided into at least two individual sections.

Correspondingly, one typical method according to the invention for collecting material from a water system comprises at least the following steps:

- holding a cargo space in a water system,
- leading water of a water system and/or material to be collected in it to the cargo space,
- discharging water from the cargo space.

The cargo space can be, for example, an ordinary barge-resembling vessel, having a typical traveling direction which is thus also a typical traveling direction for the apparatus, i.e. a collecting direction. The cargo space can also be a floating storage container. A collecting means, such as a collect opening, is typically located forward of the cargo space or in communication with its fore section as considered in the apparatus' traveling direction. Accordingly, as the apparatus is moving relative to a water system in its typical traveling direction, the material to be collected in water finds its way automatically first to the collecting means or to its vicinity. One typical collecting means according to the invention comprises a collecting platform connected to the cargo space, the water of a water system and/or the material therein to be collected being arranged to traverse said platform prior to working its way into the cargo space, wherein the surface of water and the material to be collected is typically at least roughly on the same level as the surface of a water system surrounding the cargo space. The function of a collecting platform may be, for example, to even out the flow of water and/or material to be collected coming to the apparatus, for example by suppressing the power of waves. In addition, the position of a collecting platform relative to the water level of a water system can be used for controlling the amount of water and a material to be collected coming to the apparatus. Material to be collected can also be lead on top of the collecting platform, for example for cleaning. The collecting platform can also be arranged as a gate, which, in a certain position, is arranged to close the collect opening in a mainly watertight manner.

In addition to simple exhaust openings arranged in the bottom of a cargo space of the apparatus, the means for discharging water from the cargo space may comprise for example pumps or so-called propeller tunnels. The exhaust openings can be simple openings located in the aft section of the cargo space, below the water surface of a water system. Exhaust openings may also exist in a rear wall of the apparatus' cargo space.

A typical design of the apparatus is such that while it is moving with respect to a water system, pressure differences and currents which draw water out through the cargo space exhaust openings without pumps or other mechanized water draining equipment, are generated. The means for discharging water from the cargo space are such that they can be closed as desired for blocking the currents.

The apparatus according to the invention is suitable for collecting a variety of materials present in a water system. In particular, the invention is easy to utilize in the collection of materials lighter than water or otherwise present near the surface of a water system. The apparatus according to the invention is highly suitable for use as an oil-spill combating vessel, i.e. for collecting oil from a water system. The apparatus according to the invention is highly suitable for use as a rescue vessel, i.e. for rescuing people, who have ended up in water, from waters. Other possible materials capable of being collected by means of the invention include, for example, life rafts, logs and other timber, blue-green algae, various wastes, and bilge water from ships, as well as dead animals, such as fish. It is also conceivable that the apparatus according to the invention could be used for collecting oil-stained or dead aquatic fauna, such as waterfowl or fish. If the invention is used for rescuing people, the collecting platform and the cargo space can be outfitted with equipment, by means of which the people to be rescued are more easily rescued. Such equipment for people to grab are for example various nets, ropes, railings, grate floors, and stairs. In the apparatus units according to the invention intended for rescuing people, the cargo space is preferably designed to be suitable to be used by people. A people rescue vessel does not necessarily require special means for controlling the draught of a cargo space or equipment for adjusting the elevation of a collecting platform. Neither is it absolutely necessary on a people rescue vessel to deliver water into the cargo space. In one embodiment, persons being rescued are guided into the cargo space along with water. The cargo space may include rescue decks to facilitate the salvage work. The cargo space may include intermediate floors with apertures, on top of which the rescued people and other material collected with the apparatus can be held while water flows to below the intermediate floor.

A typical apparatus of the invention is provided with means for adjusting the elevation of a collect opening or a collecting platform relative to the water level as desired. In one embodiment, the depth of a collect opening or a collecting platform is regulated by means of ballast tanks. In a typical method of the invention, the elevation of a collect opening or a collecting platform is controlled. This enables controlling for example the depth at which the material to be collected is taken into the cargo space along with water.

A typical apparatus of the invention is provided with at least one ballast tank for controlling the draught of a cargo space as desired and/or with equipment for controlling the efficiency of water discharge means. If the collecting platform is fastened permanently to a cargo space or the size of the collect opening cannot be controlled for example by means of a closing gate, such means can also be used for controlling the height of a collect opening or a collecting platform from the water level. While collecting oil, for example, the collecting platform can lie in a mainly horizontal position. When rescuing people, it may be beneficial, for example in high waves, that the fore end of the collecting platform be held at a lower level than its aft end coupled with the cargo space.

Controlling the draught of a cargo space enables also an adjustment of the collecting depth. Controlling the size of water exhaust openings or the efficiency of exhaust means enables regulating the ability of a cargo space to take up replenished water and material to be collected. The water to be taken up and the material to be collected into the apparatus are typically guided from a collect opening or a collecting platform into a cargo space totally without pumps or other mechanical transfer equipment, for example by making use of a water current resulting from flowing water or movement of the vessel.

Typically, in communication with ballast tanks are also arranged means necessary for their operation. Ballast tanks are used in a known manner for steadying empty or underloaded vessels, e.g. cargo ships. In the present invention, the ballast tanks of the apparatus are surprisingly used for providing an appropriate draught and position with respect to the surface of a water system while collecting material and specifically while unloading collected material or cargo. Thus, ballast tanks are not necessarily needed in this invention for steadying the running of the apparatus.

In one embodiment of the invention, the ballast tank is divided into two parts, one part of which is used for adjusting the draught of the cargo space by loading it with a desired amount of water and by unloading water. The other part is constant, nor is it supplied with water by pumping or otherwise, and it is adequate for carrying a fully loaded cargo space and for making sure that the cargo space remains floating on the surface.

In one embodiment of the invention, the ballast tank is divided into two parts in a substantially vertical direction, i.e. co-directionally with the water level. Thus, preferably, the lower part is used for draught adjustment. The ballast tank can be divided into various parts also in a lateral direction.

In one embodiment of the invention, the ballast tank is divided into at least two parts in a direction perpendicular to the direction of water level. This enables adjusting the position and balance of a cargo space relative to the water level.

In one embodiment of the invention, the apparatus is a vessel, comprising propulsion power units, such as an engine, and steering means for maneuvering the apparatus independently on the surface of a water system. Such an apparatus is capable of operating with total independence. The apparatus according to the invention can be a vessel navigable with total independence.

In one embodiment of the invention, the apparatus can be towed or pushed, for example by means of a tugboat. In one embodiment of the invention, the apparatus comprises attachment means for coupling a separate propulsion power unit, for example a pusher tugboat, with the apparatus. These attachment means can be similar to those used in so-called pusher barges.

In one embodiment of the invention, the collecting means comprises means for tilting a collecting platform with respect to the water level of a water system. By turning or tilting the collecting platform relative to the water level of a water system to a desired position, it will be possible to control the delivery of material from a collect opening into the cargo space or onto the collecting platform.

In one embodiment of the invention, the collecting means, comprising a collecting platform and possibly means for maneuvering the collecting platform, is a unit which is self-buoyant on the surface of water and detachable from the cargo space. Such a collecting means is attached at its rear section to the fore section of a cargo space for the duration of a collecting process. Typically, the collecting platform has its aft edge connected in a functional engagement with the cargo space, such that the water and/or the material therein to be collected, having traversed over the collecting platform, are readily able to proceed into the cargo space. In one embodiment of the invention, the collecting means is arranged as a single element integral with the cargo space.

In one embodiment of the invention, the collecting means is in the form of a ramp arranged in connection with a fore section of the cargo space. The ramp is held in a low position, e.g. on a horizontal level, as material is being collected from the surface of a water system. When the collection process is concluded, the ramp is hoisted up. The ramp position is one of the factors that define a capacity of the cargo space.

In one embodiment of the invention, the apparatus comprises a substantially horizontal flow edge for the cargo space. The water of a water system and/or the material therein to be collected must travel over the flow edge for gaining access to the cargo space. A collecting platform fastened to a side of the cargo space or an aft section of the collecting platform, fastened to the cargo space, may function as such a flow edge. It is also possible for the flow edge to be a board or edge of the cargo space, separate from the collecting platform and placed between the collecting platform and the cargo space. The flow edge determines a height above which the water of a water system and the material to be collected can travel into the cargo space.

In one embodiment of the invention, the flow edge of a cargo space functions simultaneously also as a collecting platform. This enables providing a highly simple apparatus of the invention—the collecting platform may thus comprise just a flow edge of the cargo space.

One embodiment of the invention is provided with means for adjusting the height of a collect opening's bottom edge or a cargo space's flow edge with respect to the cargo space. For example, fore edge of the cargo space or a section of its fore edge, or a collecting means arranged in connection therewith, may be arranged to be vertically movable along rails or the like. Controlling the height of the edge enables adjusting the depth of collecting water and material to be collected. On the other hand, adjusting the height of the edge or the collecting means arranged thereto may also alter the maximum capacity of the cargo space—in general, the cargo space can only hold liquid material up to the height of its sides.

In one embodiment of the invention, the height of a cargo space's leading edge, i.e. the height of a collect opening's bottom edge or a flow edge, is adjustable more or less along the entire height of the cargo space's leading edge. The further down the flow edge is lowered, the shallower is the draught that can be arranged by means of ballast tanks, provided that the flow edge is simultaneously maintained more or less in line with the surface of a water system. Thus, even a sizable apparatus can be taken to shallow waters. This is particularly advantageous for example in shore areas. However, this would not allow a total utilization of the high load capacity. In case the collect opening's bottom edge or the cargo space's flow edge is lowered further, e.g. 5-40 cm or 10-100 cm below the water level, it is also possible to collect a material, e.g. ice sludge, present underneath the surface of a water system.

In one embodiment of the invention, the apparatus comprises means for producing a water jet and/or a steam jet. Water jets or steam jets capable of being directed for example by means of suitable pumps, pipes, hoses, sprayers, and nozzles can be used in a variety of ways, for example for directing oil to be collected towards an apparatus of the invention. Such an apparatus can also be used for firefighting purposes.

Cleaning oil-covered ice with the currently available equipment is difficult. The invention enables washing pieces of ice for example on top of a grate element placed upon the collecting platform, or on top of an intermediate floor in the cargo space, for example by means of steam or a water jet. Hence, the oily water runs for example through the collecting platform's grate floor and further along the collecting platform or through the intermediate floor into the cargo space. Pieces of ice can be lead onto the intermediate floor, the collecting platform or said flat grate element by means of rails, which are arranged to extend from the apparatus' leading edge to the cargo space or, for example, from the collecting platform's leading edge to the top of the collecting platform and which rails are mainly parallel to the traveling direction of the apparatus. After the washing site, the rails can be arranged to turn to the sides of the apparatus for guiding the pieces of ice in a lateral direction from the side of the apparatus back into the water system. On the other hand, a small amount of ice or ice sludge ended up into the cargo space does not typically hinder operation of the invention. One embodiment of the invention comprises:

- using an apparatus of the invention for collecting water, ice, and oil from a water system onto a collecting platform,
- producing a water jet and/or a steam jet either in the apparatus itself or by external means,
- rinsing the ice present on top of the collecting platform with the produced water jet and/or steam jet,
- leading ice back into the water system.

One embodiment of the invention comprises using the invention for cleaning an oil-polluted shore. This involves:

- bringing a cargo space and a collect opening or a collecting platform to the proximity of an oil-polluted shore,
- arranging at least one oil boom or a corresponding oil controller from the collect opening or the collecting platform or from the vicinity thereof on the shore or its proximity,
- opening a water exhaust opening and/or using water discharge means for establishing a current running through the cargo space,
- producing a water jet and/or a steam jet,
- cleaning the shore with the produced water jet and/or steam jet,
- directing oil released from the shore to the surface of a water system and further to the collect opening or the collecting platform and into the cargo space.

This type of application would be relevant especially on shores, which are hard to reach and difficult to supply with recovery equipment by land. These include e.g. reeds, coastal marshlands, and many islands. Such an application is also highly suitable, for example, for cleaning harbor basins or other sheltered water areas. The apparatus may come outfitted with oil booms or the like. The oil booms or the like can be arranged to be turned by hydraulic power to an appropriate position. A water jet or a steam jet can be produced within the apparatus of the invention itself if the apparatus is provided with suitable means to do that. It is also possible to bring for example pressure cleaners by land to the site. According to one embodiment of the invention, the apparatus comprises a reed cutter for cutting and collecting oil-soiled reeds and other shoreline vegetation.

In one embodiment of the invention, the apparatus features hydraulic power generating means as a power supply unit for necessary movable components. According to one application, the employed hydraulic fluid, at least in warm season, is water or an environmentally friendly vegetable oil, such that the collecting apparatus itself, even in damaged condition, would not constitute an environmental hazard at least in this respect.

The apparatus according to the invention can be manufactured in a size appropriate for each particular application. Typically, the cargo space can be for example 10-120 meters in length, 3-25 meters in width, and 1-5 meters in height. The collect opening and the collecting platform are typically slightly narrower than the cargo space. The collecting platform is for example 2-30 meters in length. If the collecting means is a device which is detachable from the cargo space and capable of floating in its own right, it will typically have a width which is more or less equal to that of the cargo space and a length which is for example 3-30 meters.

A system of the invention for collecting material from a water system comprises at least two apparatuses according to the invention, as well as a shore-installed unloading station for the cargo spaces of said apparatuses. The use of several apparatuses makes it possible to set up a highly efficient and comprehensive oil-combating system, even for a large area. Apparatuses can be arranged side by side, for example one or several apparatuses on either side of a tugboat or the like vessel, for establishing a larger sweeping range.

The system becomes particularly advantageous if the apparatus units themselves are made inexpensive, for example as sort of pusher barges, without their own propulsion power units. In this case or even in other cases, empty apparatus units could be located scattered along the coastlines. With such a system, for example in the event of an oil spill, at least one apparatus unit can always be quickly brought to the site. Other empty apparatus units can then be towed or otherwise brought to the site ready to work. One vessel engageable with the apparatus units, for example a pusher tugboat, can then be used for filling up the cargo space of one apparatus unit, and quickly replacing the loaded one with a new empty apparatus unit. Thus, there is no need to leave the site for unloading the apparatus units at the harbor, resulting in a particularly efficient recovery process. For example, the fully loaded apparatus units may remain in the vicinity of a spill site as intermediate storage facilities, for example left to float in the water, and can be transported for unloading whenever there is time for that. As some of the most significant benefits of the system according to the invention should be mentioned that

- an almost unbroken oil collection is possible even far from harbors, as long as a sufficient number of storage barges is available on site,
- the system is very inexpensive in terms of its purchase price,
- the cleaning capacity is high,
- the system is quickly ready for work,
- the collecting apparatus units do not require a crew in a standby condition,
- necessary power sources are readily available in a pushing vessel.

In one application of a system and a method according to the invention, oil or other material to be collected is removed from a water system into a floating cargo space and then ashore for further processing without pumping of oil and without moving oil by mechanical contact, for example without brushes or conveyors. For example, the material to be collected can be removed from a water system into a cargo space as described above, by means of the kinetic energy of flowing water. The oil or other material to be collected is transferred from a floating cargo space onto the solid ground, for example by draining ballast tanks whereby the cargo space is raised and oil or other material can be discharged gravitationally out of the cargo space. The cargo space or the entire apparatus can also be hoisted in the air, e.g. by a crane, whereby the oil or other material can be drained or, by tilting the cargo space, poured e.g. into a storage reservoir.

BRIEF DESCRIPTION OF THE FIGURES

The invention will now be described more closely with reference to the accompanying schematic drawing, in which.

DETAILED DESCRIPTION OF THE EXAMPLES OF THE FIGURES

Figures 1, 2, 3:
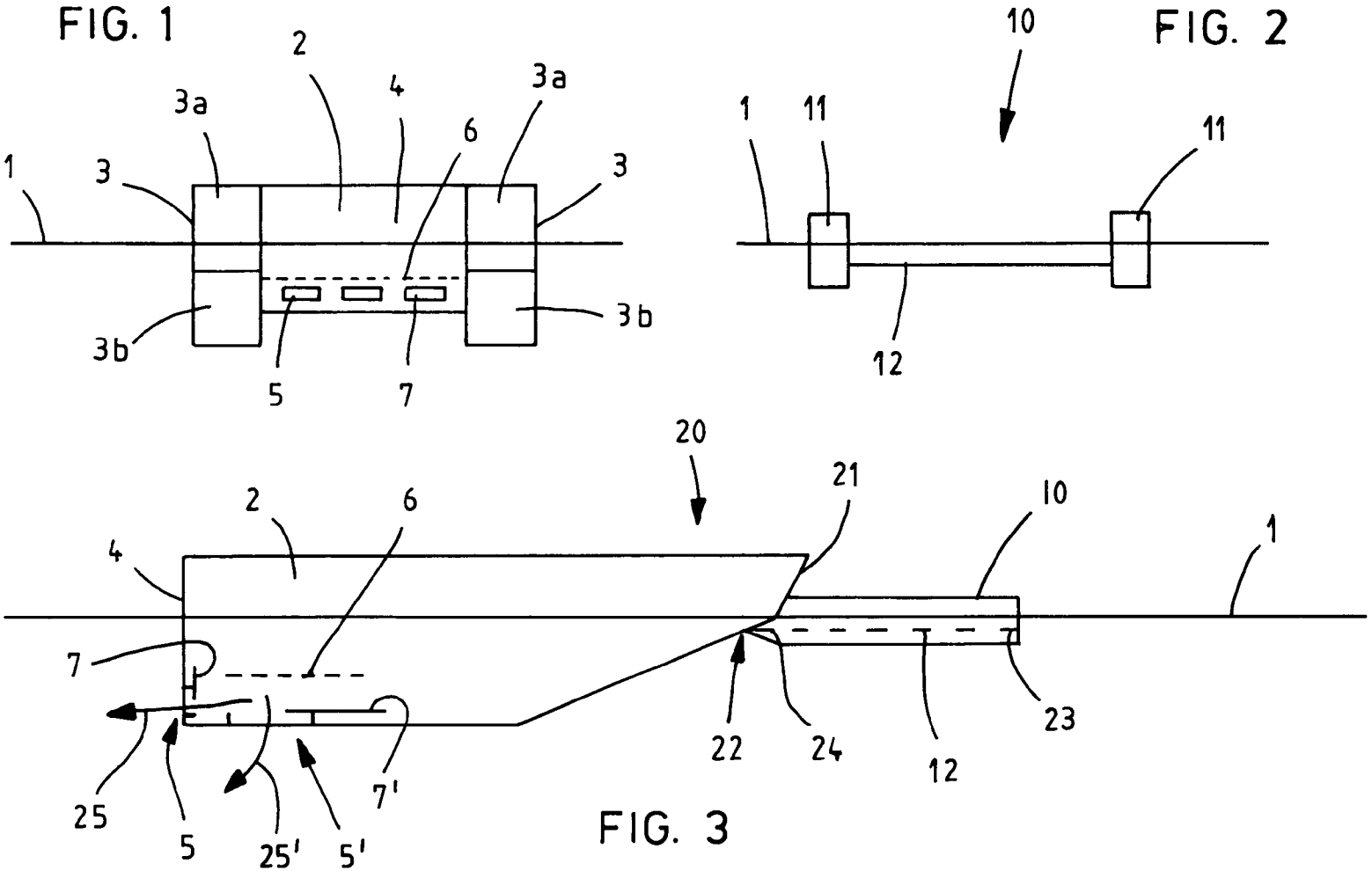
FIG. 1 shows one cargo space of the invention seen from behind.
FIG. 2 shows one collecting means of the invention seen from ahead.
FIG. 3 shows one apparatus of the invention seen from the side.

A water system's water level 1 is sketched in all FIGS. 1-3 and 4 in solid line. For the sake of clarity, corresponding components in various applications are designated with same reference numerals.

FIG. 1 illustrates, in a view from behind, a cargo space 2 of the invention floating on the surface 1 of a water system. On the sides of the cargo space 2 are ballast tanks 3, which are divided into two parts 3*a*, 3*b* in a vertical direction of the cargo space 2, i.e. co-directionally with the water system's surface 1. In this example, no water is pumped into the ballast tanks' 3 upper parts 3*a*, but they are maintained empty at all times for ensuring thereby the buoyancy of the cargo space. Water is pumped into and out of the lower part 3*b* for controlling the draught of the cargo space. At the bottom edge of the rear wall 4 of the cargo space, there are three outlets 5, leading from the interior of the cargo space to the water system. The openings can be adjusted in size by means of closing gates 7. It can be seen in FIG. 3 that in the bottom of the cargo space there is also a water exhaust opening 5', having its size adjustable by means of a gate 7'. Above the bottom exhaust opening 5', yet below the water level, is arranged an intermediate floor 6 with apertures therein. A line is sketched in the cargo space for representing the water level 1 also inside the cargo space 2.

FIG. 2 illustrates, in a view from ahead, a separate collecting means 10 of the invention attachable in front of a cargo space. On the sides of the collecting means 10 are ballast tanks 11, which function as a supporting hull for the collecting means. Between the ballast tanks 11 is arranged a collecting platform 12. It is seen in FIG. 2 that the collecting platform is somewhat below the water level 1. The collecting platform 12 is typically arranged in a mainly horizontal position slightly below the water level 1 whereby water and oil that pass through the collecting means 10 travel over it. The collecting platform 12 suppresses the wave motion of water on top of it, thus enhancing the cleaning efficiency. The collecting platform 12 also stabilizes the running of, for example, the catamaran-hulled cargo space 2 and collecting means 10. It is also possible design the collecting platform 12 in such a way that it functions for its part as a mechanical guide for water and oil. The collecting platform 12 is preferably attached to the rest of the apparatus 10 with such means, for example hydraulic cylinders, which allow the collecting platform 12 to be adjusted in terms of its inclination and height relative to the water level 1. Typically, the collecting panel 12 is held at 50-1000 mm or 300-700 mm below the water level 1. The collecting platform 12 also is useful as the invention is applied in icy waters. In this case, the collecting platform 12 can be set, for example, in a slightly forward inclination, such that pieces of ice rise along itself, or along rail elements or a conveyor mounted on top of it, at least partly above the water level 1. Water jets or steam jets according to the invention can be used for rinsing pieces of ice traveling on top of the collecting platform 12, whereby at least some of the oil adhered to ice can be recovered with the apparatus 20.

FIG. 3 illustrates how the cargo space 2 and the collecting means 10, depicted in FIG. 2, in an assembled condition make up an apparatus 20 of the invention for collecting material from a water system. The collecting platform 12 can be tilted forward or backward in the apparatus' traveling direction. In the situation of FIG. 3, the collecting platform 12 is in a more or less horizontal position and somewhat below the water level 1. Between the collecting means 10 and the cargo space 2, to a forward wall 21 of the cargo space is formed a collect opening or a flow edge 22 of the cargo space. It is coplanar with the collecting platform 12. The cargo space 2 shown in FIGS. 1-3 can also be used without the collecting means 10. In this case, the water to be drawn into the cargo space is brought in directly through the collect opening 22.

As seen in FIG. 3, the water level inside the cargo space is coplanar with the water system's surface level 1. For the sake of clarity, the illustrated apparatus 20 has been shown without any propulsion power sources. The cargo space, for example, could be arranged with engines and propulsion power devices, such as propellers and steering equipment, for an independent operation of the apparatus 20. The rear wall 4 of the cargo space could also have separate coupling means for connecting a separate propulsion power source, for example a pusher tugboat, to the apparatus.

When collecting oil from the water surface 1, the apparatus 20 of FIG. 3 operates as follows: The apparatus 20 is moved in its traveling direction, from left to right in FIG. 3. Water and overlying oil are guided from a leading edge 23 of the collecting platform 12 present between the ballast tanks 11 onto the top of the collecting platform and further, in response to a relative movement between the apparatus 20 and the water system, towards a trailing edge 24 of the collecting platform, which edge is attached to the collect opening or the flow edge 22 of the cargo space. The water, and the oil overlying its surface 1, proceed, in response to said relative movement between the apparatus 20 and the water system, over the cargo space's collect opening or flow edge 22 inside the cargo space 2, in which the surface of collected water and oil is coplanar with the surface 1 of a water system, i.e. regardless of the applied term flow edge 22, the material being collected does not flow downward but, instead, just passes over it. With the apparatus 20 in motion, the currents of water produce a pressure difference at openings 5 and 5" in the rear wall 4 and the bottom of the apparatus, which draws water out of the cargo space 2 through the openings 5 and 5". This discharging water is represented by arrows 25 and 25'. The discharging water makes room in the cargo space 2 for incoming water and material to be collected. These water currents can be controlled for example by changing the following variables: speed of the apparatus 20, position of the closing gates 7 and 7' of the openings 5 and 5', height of the cargo space's collect opening or flow edge 22 from the water system's surface 1, height of the collecting platform 12 from the water system's surface 1, draught of the cargo space 2. As cleaner water present in the bottom section of the cargo space 2 drains back into the water system, more and more oil or other material to be collected keeps concentrating within the cargo space 2 while the apparatus 20 is operated.

Figure 4:
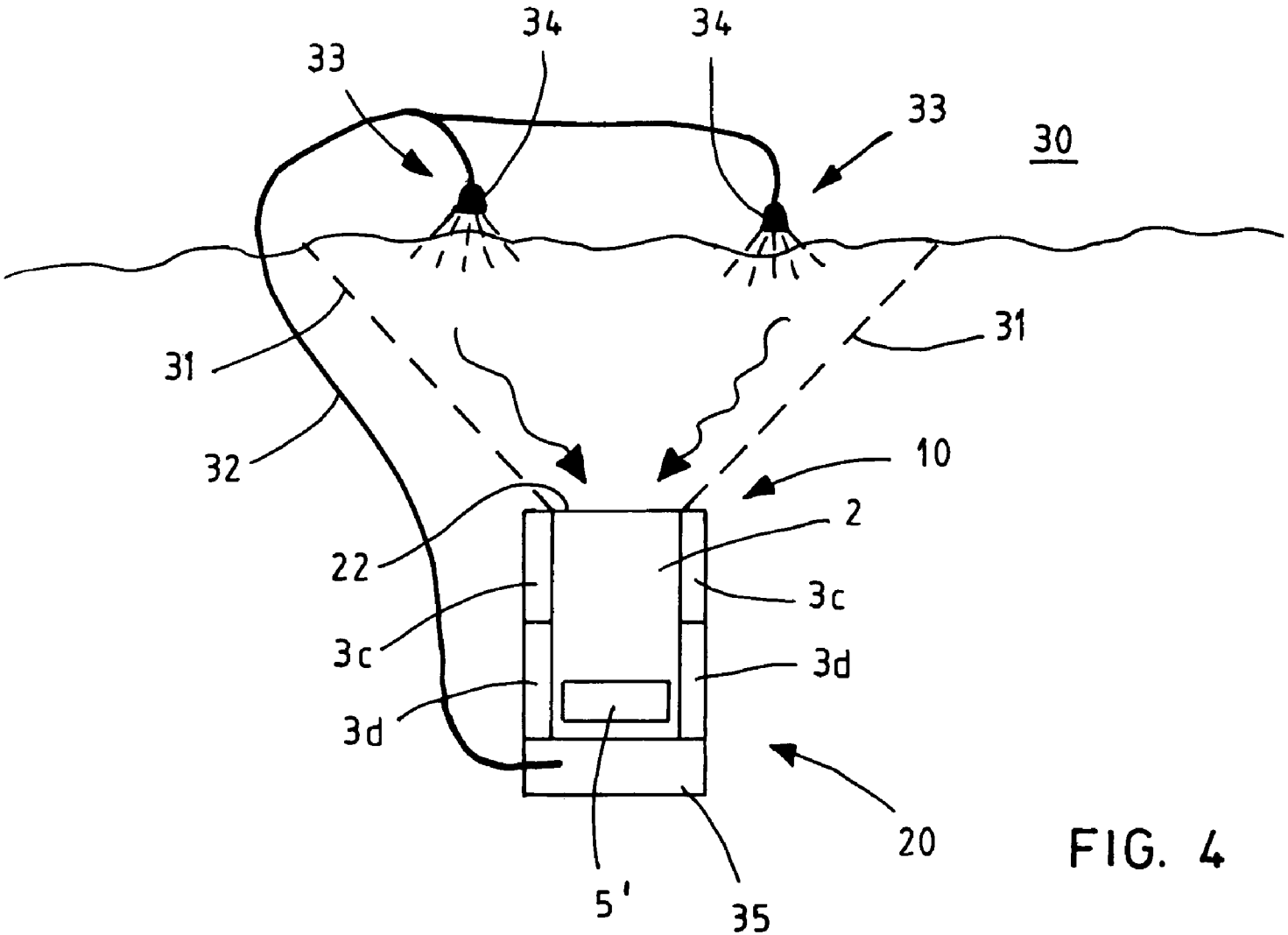
FIG. 4 shows a second apparatus of the invention seen from above.

FIG. 4 illustrates, in a view from above, an embodiment of the invention, wherein an apparatus 20 is brought to the vicinity of an oil-polluted shore 30. In the apparatus of FIG. 4, a storage container 2 and a collecting means 10 have been made up as one and the same device. In the case of FIG. 4, the collecting means 10 and, at the same time, the collecting platform are formed solely of the cargo space's collect opening or flow edge 22, which is located directly at the leading edge of the apparatus 20. Thus, the apparatus 20 has been made light, compact, and readily transportable near the shore 30. The apparatus 20 is provided on the sides with ballast tanks, which are divided in a longitudinal direction of the cargo space into two parts 3*c*, 3*d* for changing not only the draught but also the inclination of the cargo space. Two oil booms 31 are arranged to extend from the vicinity of the apparatus' 20 leading edge to the shore 30 in order to restrict the spreading of oil and to assist in directing it to the apparatus 20. The apparatus 20 has a technical compartment 35, which houses a pump or the like for taking water from a water system and for producing a high-pressure water jet. The pressurized water is conducted from the pump into hoses 32. The end 33 of the hose is provided with nozzles 34. The pressurized water jets sprayed from the nozzles are used for washing oil from the shore towards the water system. The oil, which has ended up on the surface of water, finds its way, according to the invention and as indicated by arrows, into the cargo space 2. From the bottom of the apparatus, water is discharged through the bottom exhaust opening 5'. The technical compartment 35 houses also a propulsion power source, for example a water jet engine, for the apparatus 20.

Figure 5:
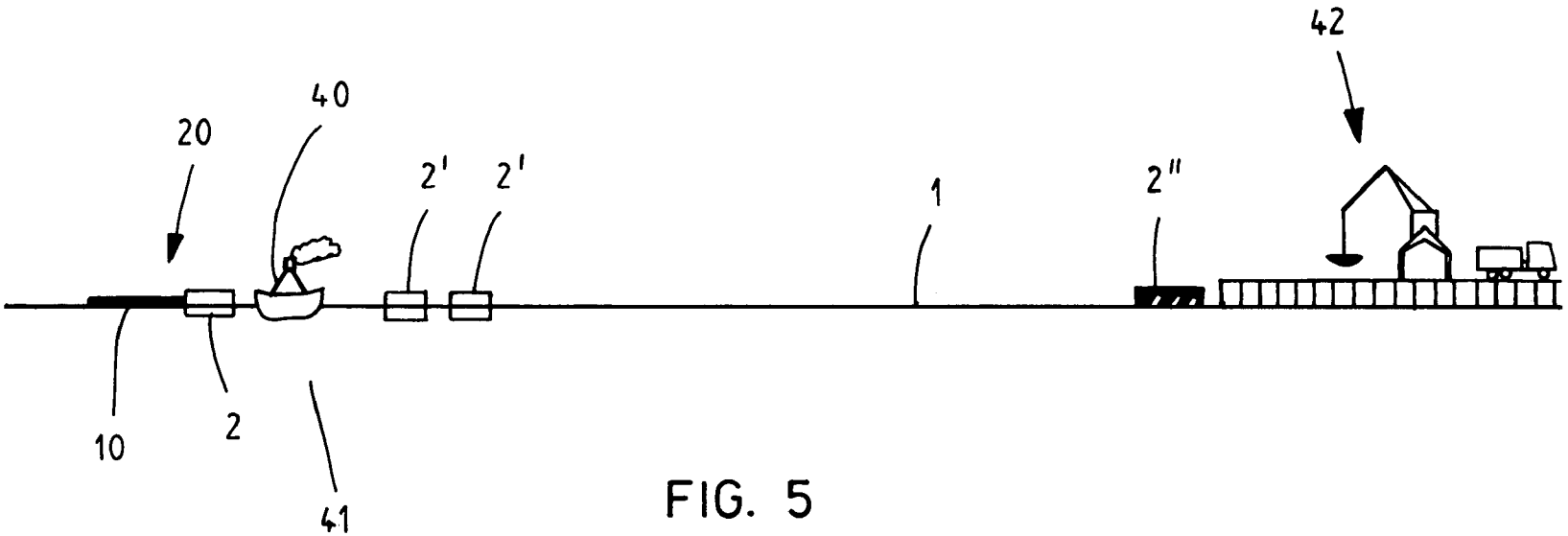
FIG. 5 shows a system of the invention.

Illustrated in FIG. 5 is a system of the invention for collecting material from a water system. In the situation of FIG. 5, the material to be collected consists of oil, which has managed to spill over a water area 41 shown on the left side of FIG. 5. At the spill site 41 is seen one apparatus 20 of the invention, which is in the process of collecting oil and which includes a collecting means 10, a cargo space 2, and a pusher tugboat 40 propelling them. Two empty cargo spaces 2' have been brought to the spill site 41. One fully loaded cargo space 2" has been transported ashore, to the pier of an unloading station 42 for cargo spaces. The cargo spaces 2, 2', 2" are detachable from and re-attachable to the collecting means 10 and the pusher barge 40. Typically, the cargo spaces 2, 2', 2" are always loaded to a certain degree of fullness, whereafter the loaded cargo space is detached and it is replaced with another, empty cargo space, which is fastened between the pusher barge 40 and the collecting means 10. According to the invention, the fully loaded cargo space 2" can be transported for storage or unloading, for example to the unloading station 42. After the unloading operation, the first, now empty cargo space can be re-connected as a part of the oil-collecting apparatus 20. With this arrangement, a nonstop type of collection logistics is provided. The apparatus 20 can be in continuous use on the oil-polluted water area 41, just the cargo spaces 2 are replaced with empty ones whenever necessary. The cargo spaces 2 of a barge type are inexpensive to manufacture and, hence, a large number of them can be provided in anticipation of large-scale accidents.

If the cargo spaces 2 comprise means for pumping water onto the bottom of the cargo space, the cargo spaces 2 can be conveniently unloaded at the unloading station 42, for example as follows: The exhaust openings 5 and 5', and typically the collect opening 22 as well, are maintained in a closed position. Water is pumped onto the bottom of the cargo space filled at least partially with collected material, whereafter the water lifts upward the material that is lighter than water, such as oil, contained in the cargo space 2. Hence, the upward rising oil can be readily conducted, possibly gravitationally, to a further treatment. According to a preferred embodiment, the ballast tanks are made lighter, whereby the cargo space 2 rises and oil or other material can be drained gravitationally away. In a system and method according to the invention, the oil or other collected material can be thus transferred from the water system 1 into the cargo space 2 and further onto land for further processing 42, totally without having to pump oil and without having to transport oil with any mechanical contact.

It is possible that the cargo spaces 2 according to the invention comprise in and of themselves means for separating water from oil and means for conducting water out of the storage container. Such storage containers may comprise for example a plurality of so-called settling tanks (not shown) through which the oily water is circulated. Cleaner water present in the bottom parts of settling tanks is pumped back into the water system as necessary. Settling technology is previously known as such and, thus, shall not be discussed further here.

Figure 6:
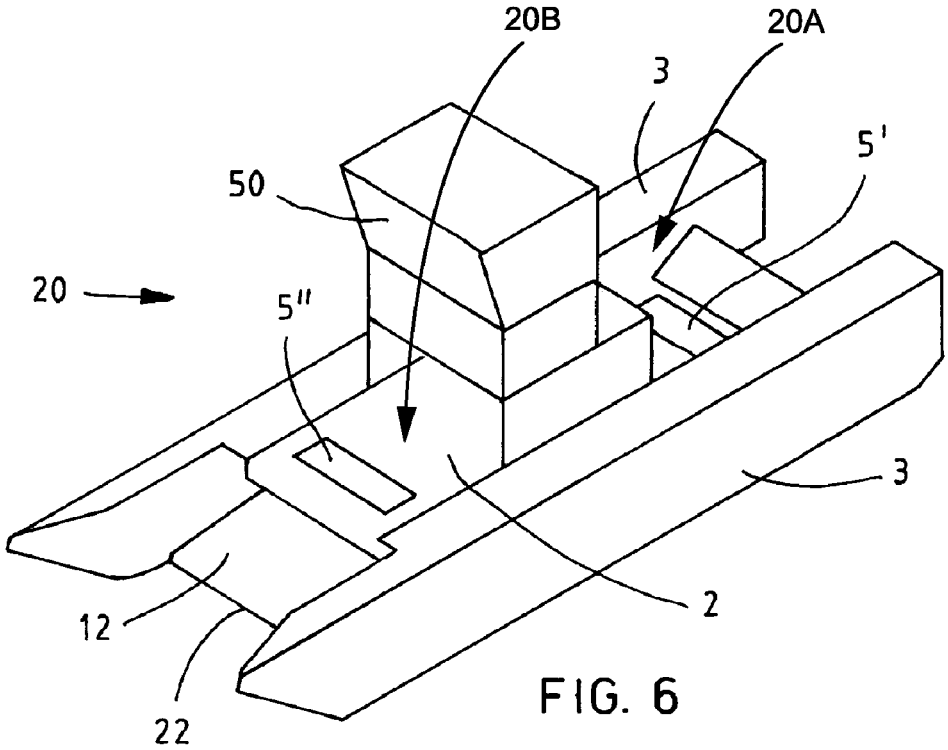
FIGS. 6 and 7 show an apparatus 20 according to one embodiment of the invention.
Figure 7:
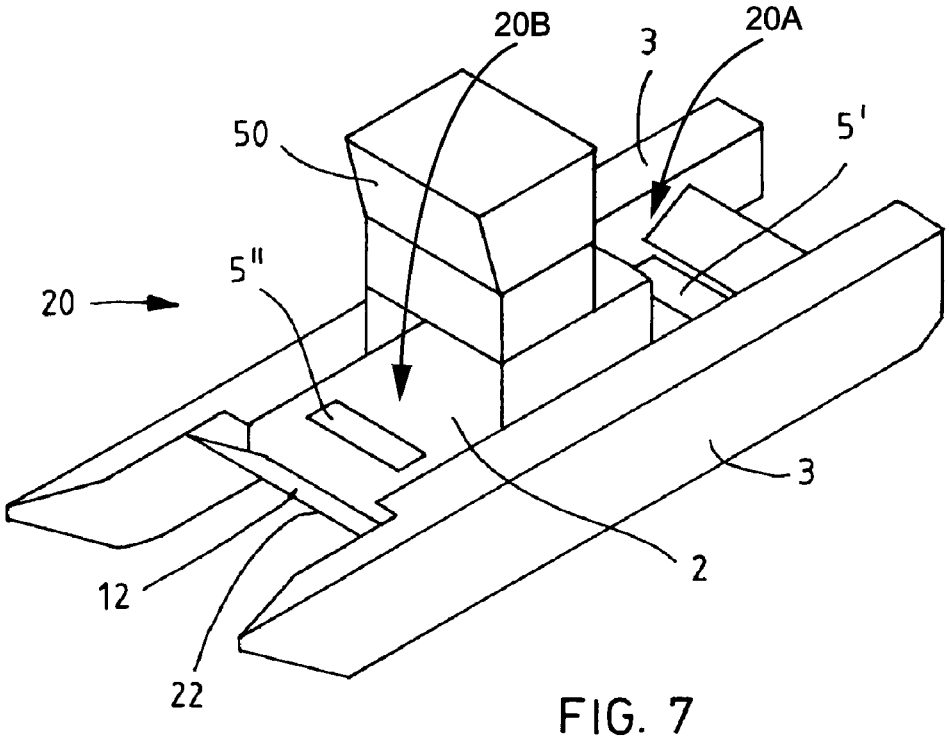

FIGS. 6 and 7 illustrate an apparatus 20 according to one embodiment of the invention. This apparatus 20 is a vessel, comprising a cargo space 2, ballast tanks 3, a collecting platform 12, as well as an engine and a cabin 50. The vessel 20 can be totally independent in its operation. In the bottom of its aft section 20A near the vessel stern, the vessel 20 has a water exhaust opening 5', and the bottom of its fore section 20B near the vessel bow features an exhaust opening 5" for discharging water from the cargo space. For the sake of clarity, FIGS. 6 and 7 do not depict closing means, such as gates, for the exhaust openings 5' and 5". In FIG. 6, the collecting platform 12 is in a lowered collecting position and FIG. 7 shows it in an uplifted transport position. The edge of the collecting platform 12 functions as the bottom edge of a collect opening 22 in the apparatus 20. Thus, the height of the bottom edge of the collect opening 22 can be adjusted as desired with respect to the water system's surface, either by adjusting the position of the collecting platform 12 or by controlling the degree of fullness of the ballast tanks 3.

The figures illustrate but a few preferred exemplary embodiments of the invention. The figures do not specifically depict aspects, which are of a secondary value in view of the principal idea of the invention, which are known per se or obvious as such for a person skilled in the art, and which include power sources, pumps, bracing structures possibly needed by the invention, actuators required for emptying and filling ballast tanks, or coupling mechanisms for barges, tugboats, and other vessels. It is self-evident for a man skilled in the art that the invention is not limited solely to the above-mentioned examples, but that the invention may vary within the scope of the appended claims. The dependent claims present a few feasible embodiments of the invention, and they should not be construed, as such, to limit the scope of protection of the invention.

The invention claimed is:

1. An apparatus for collecting material from or close to a surface of a water system, the apparatus comprising:

a vessel which is buoyant in the water system and includes, relative to a travel direction of the vessel along the water system, a fore section near a bow of the vessel and an aft section near a stern of the vessel;

a cargo space having a bottom defined between the fore and aft sections of the vessel;

a forward collect opening positioned forwardly of the fore section near the bow of the vessel, the collect opening being in communication with the cargo space for conducting water and material therein to be collected into the cargo space;

a fore exhaust opening positioned in the bottom of the cargo space at the fore section of the vessel adjacent to the forward collect opening near the bow of the vessel, and an aft exhaust positioned in the bottom of the cargo space at the aft section of the vessel near the stern of the vessel, wherein the fore and aft exhaust openings allow discharge of water from the cargo space back to the water system; and controllable closure devices operatively associated with and allowing size adjustment of the collect opening and the fore and aft exhaust openings to cause the water and the material therein to be collected to stream into the cargo space in response to the apparatus moving in the travelling direction thereof which in turn causes the water in the cargo space to drain back into the water system through the fore and aft exhaust openings.

2. An apparatus according to claim 1, which further comprises buoyant elements to render the apparatus unsinkable.

3. An apparatus according to claim 1, which further comprises buoyant elements to avow for draught adjustment of the apparatus.

4. An apparatus according to claim 3, wherein the buoyant elements comprise at least one ballast tank and equipment for filling and emptying the at least one ballast tank.

5. An apparatus according to claim 1, wherein the closure devices control the sizes of the collect opening and the fore and aft exhaust opening such that the size of the fore and aft exhaust openings has a surface area which is 0.5-5 times a surface area of the collect opening.

6. A method for collecting material from or close to a surface of a water system, said method comprising:

maneuvering an apparatus which includes a vessel buoyant in the water system having, relative to a travel direction of the vessel along the water system, a fore section near a bow of the vessel, an aft section near a stern of the vessel and a cargo space having a bottom defined between the fore and aft sections;

conducting water which is present at or close to the surface of the water system and material therein to be collected through a collect opening located forwardly of the fore section near the bow of the vessel and into the cargo space;

conducting water from the cargo space back into the water system through a fore exhaust opening positioned in the bottom of the cargo space at the fore section of the vessel adjacent to the forward collect opening near the bow of the vessel, and an aft exhaust opening positioned in the bottom of the cargo space at the aft section of the vessel near the stern of the vessel; and varying sizes of the collect opening and the fore and aft exhaust openings to cause the water and the material therein to be collected to stream into the cargo space in response to movement of the apparatus in the travelling direction thereof which in turn causes the water present in the cargo space to drain back into the water system through the fore and aft exhaust openings.

7. A method according to claim 6, further comprising providing a buoyant elements to ensure unsinkability of the apparatus.

8. A method according to claim 6, further comprising controlling draught of the apparatus by controlling buoyancy of buoyant elements operatively associated with the apparatus.

9. A method according to dam 8, wherein the buoyant elements comprise at least one ballast tank, and wherein the method comprises controlling the draught of the apparatus by controllably filling and emptying the at least one ballast tank.

10. A method according to claim 6, further comprising controllably adjusting a size of the fore and aft exhaust openings to establish a surface area which is 0.5-3 times a surface area of the collect opening.

* * * * *